US008723739B2

(12) United States Patent
Liu et al.

(10) Patent No.: US 8,723,739 B2
(45) Date of Patent: May 13, 2014

(54) MULTI-FREQUENCY ANTENNA

(75) Inventors: Ta-Cheng Liu, Taoyuan County (TW); Chung-Ta Wu, Taoyuan County (TW)

(73) Assignee: Perfect Wireless (Taiwan) Technology Co., Ltd., Luzhu Township, Taoyuan County (TW)

( * ) Notice: Subject to any disclaimer, the term of this patent is extended or adjusted under 35 U.S.C. 154(b) by 222 days.

(21) Appl. No.: 13/469,521

(22) Filed: May 11, 2012

(65) Prior Publication Data

US 2013/0300628 A1 Nov. 14, 2013

(51) Int. Cl.

| | |
|---|---|
| ***H01Q 1/24*** | (2006.01) |
| ***H01Q 5/00*** | (2006.01) |
| ***H01Q 9/04*** | (2006.01) |

(52) U.S. Cl.

CPC ..... *H01Q 5/0041* (2013.01); *H01Q 5/0058* (2013.01); *H01Q 9/0421* (2013.01)

USPC ..... 343/702; 343/853

(58) Field of Classification Search

CPC ... H01Q 1/243; H01Q 5/0041; H01Q 5/0058; H01Q 9/0421

USPC ..... 343/702, 853

See application file for complete search history.

(56) References Cited

U.S. PATENT DOCUMENTS

| | | | | |
|---|---|---|---|---|
| 7,928,916 | B2 * | 4/2011 | Hung et al. | 343/702 |
| 8,373,598 | B2 * | 2/2013 | Tsai et al. | 343/700 MS |
| 8,451,177 | B2 * | 5/2013 | Shau et al. | 343/700 MS |
| 8,587,494 | B2 * | 11/2013 | Lee et al. | 343/850 |
| 2013/0027254 | A1 * | 1/2013 | Korva et al. | 343/702 |

FOREIGN PATENT DOCUMENTS

| | | |
|---|---|---|
| TW | M391734 | 11/2010 |

* cited by examiner

*Primary Examiner* — Robert Karacsony

(74) *Attorney, Agent, or Firm* — Muncy, Geissler, Olds & Lowe, P.C.

(57) ABSTRACT

A multi-frequency antenna includes a substrate, an antenna portion and a radiator. The antenna portion has a low-frequency radiation antenna and a high-frequency radiation antenna. By selectively coupling the low-frequency radiation antenna, the high-frequency radiation antenna and the radiator, the multi-frequency antenna can work in multiple frequency bands.

5 Claims, 7 Drawing Sheets

MULTI-FREQUENCY ANTENNA

BACKGROUND OF THE INVENTION

1. Technical Field

The present invention relates to antennas working in multiple frequency bands, and more particularly to a multi-frequency antenna working in multiple frequency bands.

2. Description of Related Art

With the development of communication technology, the ITU (International Telecommunication Union) loosened its official definition of 4G to include LTE (Long Term Evolution) in 2010. Prior patents related to LIE antennas include Taiwan Patent No. M391734, which has disclosed an LTE antenna structure comprising a circuit board, a monopole antenna, a coupling element, a metal stamping, a capacitor and a signal line. The monopole antenna and the coupling element are formed on the circuit board. The coupling component circles around the monopole antenna. The metal stamping is soldered to the periphery of the circuit board. The capacitor is coupled to the monopole antenna and the coupling element. The signal line has a ground wire connected to the coupling component and a signal feeding wire contacting the monopole antenna. Therein, the patented LTE antenna structure needs the capacitor for connecting the monopole antenna and the coupling component so as to attain impedance matching, but the capacitor undesirably thickens the overall antenna structure.

SUMMARY OF THE INVENTION

The primary objective of the present invention is to provide a multi-frequency antenna, which is thinner as compared to the prior-art device, thereby answering to the tendency toward lightness and compactness for electronic devices.

The secondary objective of the present invention is to provide a multi-frequency antenna, which accomplishes impedance matching by changing the coupling among components of the multi-frequency antenna.

For achieving these objectives, according to the present invention, a multi-frequency antenna comprises a substrate, an antenna portion and a radiator. The antenna portion is deposited on the substrate and located in one side of the substrate. The antenna portion includes a low-frequency radiation antenna and a high-frequency radiation antenna. The low-frequency radiation antenna has a first connecting arm, a long arm, a second connecting arm and a short arm. The long arm has its front end connected to a top of the first connecting arm and has its rear end connected to an upper end of the second connecting arm. The second connecting arm has its lower end connected to the short arm. The second connecting arm is aligned with the first connecting arm while the short arm is aligned with the long arm. The high-frequency radiation antenna has a matching arm, a third connecting arm, a first coupler, a second coupler, a short-circuit member and a grounding arm. The matching arm has its rear end connected to a bottom of the first connecting arm. The third connecting arm has its lower end connected to a front end of the matching arm. The first coupler is connected to a top of the third connecting arm and aligned with the matching arm. The second coupler is deposited between a top of the substrate and the first coupler. The short-circuit member has its upper end connected to the second coupler and has its lower end connected to the grounding arm. The grounding arm is deposited between a bottom of the substrate and the matching arm. The radiator is deposited on the top of the substrate and face the long arm of the low-frequency radiation antenna and the second coupler of the high-frequency radiation antenna in the antenna portion. The radiator is connected to the second coupler of the high-frequency radiation antenna.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
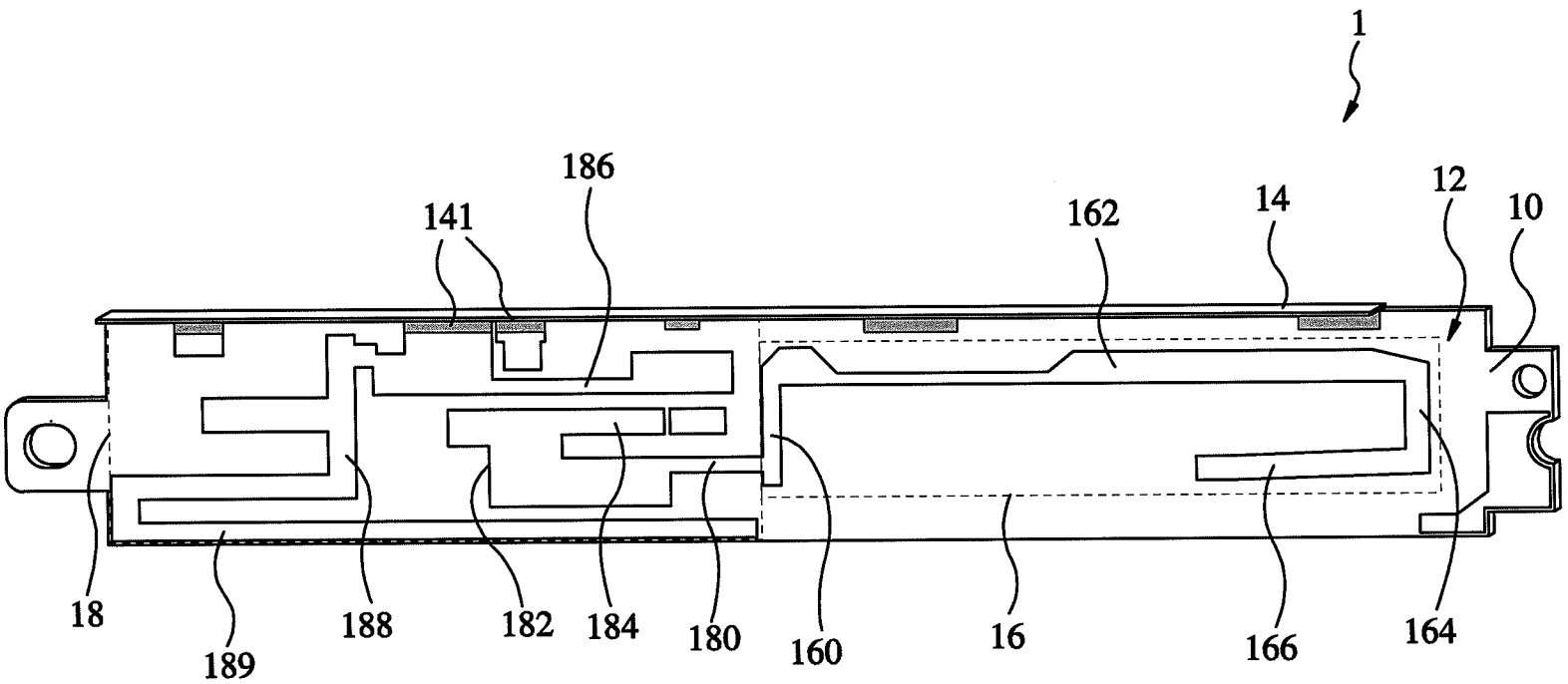
FIG. 1 is a schematic view of a multi-frequency antenna according to a first preferred embodiment of the present invention.

FIG. 1 schematically depicts a multi-frequency antenna according to a first preferred embodiment of the present invention.

The multi-frequency antenna 1 comprises a substrate 10, an antenna portion 12 and a radiator 14. The substrate 10 is typically made of a dielectric material, such as FR4 (fiberglass), Teflon or ceramics. Preferably the substrate 10 is made of FR4 substrate with a thickness of 0.8 mm, while other thicknesses may be also useful in the present invention.

The antenna portion 12 is deposited on the substrate 10 and located in one side of the substrate 10. More particularly, the antenna portion 12 is formed on the substrate 10 and extended to one lateral of the substrate 10. The antenna portion 12 includes a low-frequency radiation antenna 16 and a high-frequency radiation antenna 18. The low-frequency radiation antenna 16 and the high-frequency radiation antenna 18 are preferably formed on the substrate 10 by means of printing, adhering, plating, thick-film coating, thin-film coating or etching. In the present embodiment, the low-frequency radiation antenna 16 is a monopole antenna and has a first connecting arm 160, a long arm 162, a second connecting arm 164 and a short arm 166. The long arm 162 has its front end connected to a top of the first connecting arm 164 and has its rear end connected to an upper end of the second connecting arm 164. The second connecting arm 164 has its lower end connected to the short arm 166. The second connecting arm 164 is aligned with the first connecting arm 160 and the short arm 166 is aligned with the long arm 162.

The high-frequency radiation antenna 18 has a couple-feed structure and is formed as a loop antenna. The high-frequency radiation antenna 18 has a matching arm 180, a third connecting arm 182, a first coupler 184, a second coupler 186, a short-circuit member 188 and a grounding arm 189. The matching arm 180 has its rear end connected to a bottom of the first connecting arm 160. The third connecting arm 182 has its lower end connected to a front end of the matching arm 180. The first coupler 184 is connected to an upper end of the third connecting arm 182 and aligned with the matching arm 180. The first coupler 184 and the matching arm 180 are separated by a gap. The second coupler 186 is deposited between a top of the substrate 10 and the first coupler 184, and is separated from the first coupler 184 by a coupling gap. The short-circuit member 188 has its upper end connected to the second coupler 186 and has its lower end connected to the grounding arm 189. The grounding arm 189 is deposited between a bottom of the substrate 10 and the matching arm 180, and is separated from the grounding arm 189 by a gap.

The radiator 14 is deposited on the top of the substrate 10 and face the long arm 162 of the low-frequency radiation antenna 16 and the second coupler 186 of the high-frequency radiation antenna 18 in the antenna portion 12. The radiator 14 is connected to the second coupler 186 of the high-frequency radiation antenna. In the present embodiment, the radiator 14 is fixed atop the substrate 10 by means of soldering. The radiator 14 is preferably a metal sheet, and is perpendicular to the substrate 10. The radiator 14 serves as the major radiating structure of the multi-frequency antenna 1. Divided by a solder joint 141 between the radiator 14 and the high-frequency radiation antenna 18, there are two resonant frequency bands, namely a low frequency band of 704~800 MHz at the right side of the solder joint 141 and a high frequency band of 2000~2700 MHz at the left side of the solder joint 141, while the left terminal is the resonant position for the frequency band of 1710~1900 MHz. Thereby, the disclosed multi-frequency antenna has variable bandwidth by changing the radiator 14 in length.

It is worth noting that the low-frequency radiation antenna 16 has its main resonant frequency band covering 800~960 MHz, and the coupling between the low-frequency radiation antenna 16 and the radiator 14 has influence on antenna efficiency in both of the frequency band (2000~2700 MHz) and the entire low frequency band, as described below. The high-frequency radiation antenna 18 has its main resonant frequency band covering 1710~2700 MHz. Thus, in practical operation, the disclosed multi-frequency antenna can work in various frequency bands, meeting the technical requirements for LTE antennas.

The multi-frequency antenna 1 of the present invention is applicable to various portable electronic devices, such as tablet computers, laptop computers, mobile phones, e-books, digital photo frames, digital cameras, GPSs (Global Positioning Systems) and PDAs (Personal Digital Assistants).

Figure 2:
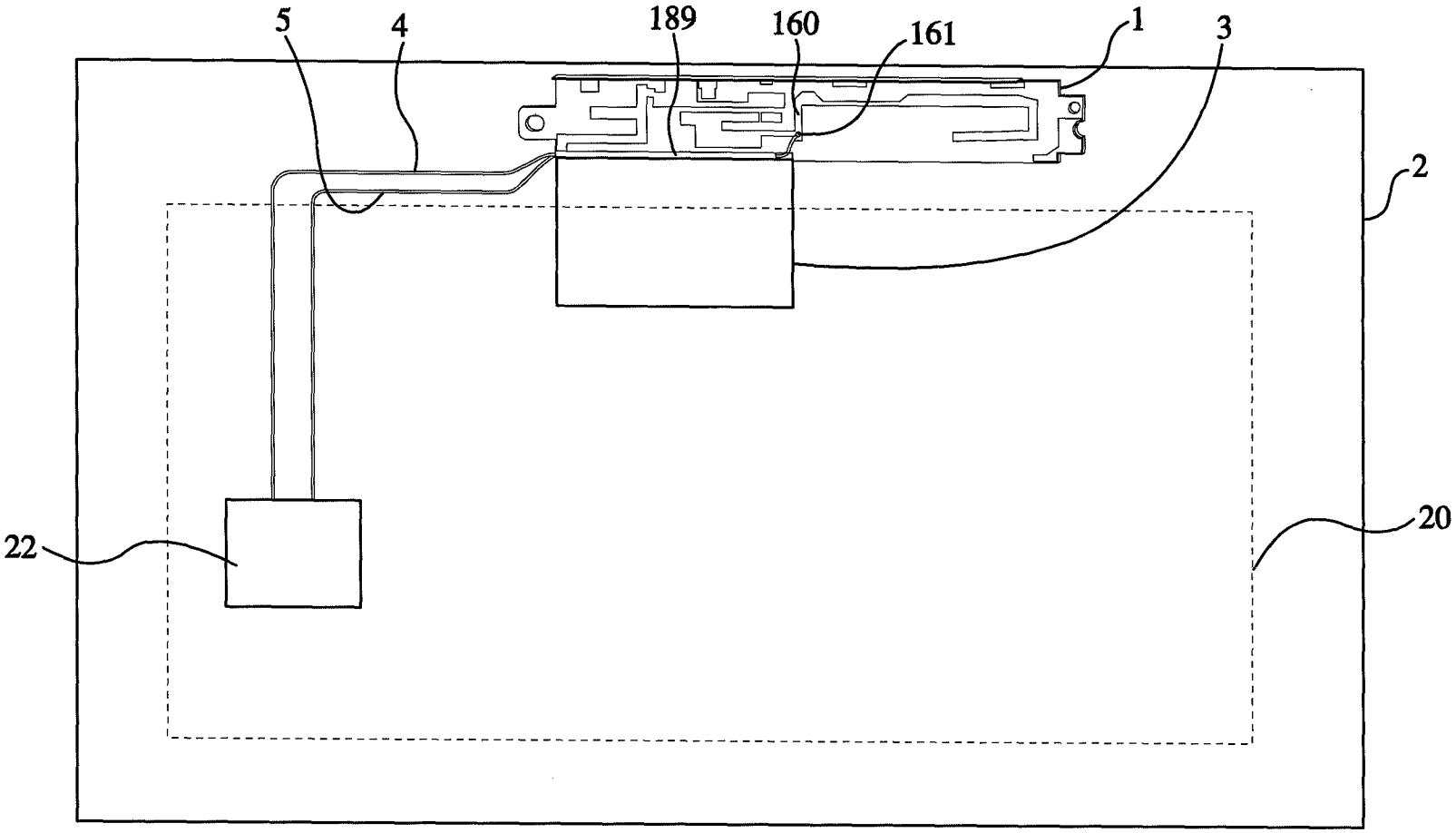
FIG. 2 is a schematic view of a portable electronic device using the multi-frequency antenna.

FIG. 2 schematically depicts a portable electronic device using the multi-frequency antenna 1. The portable electronic device has a main body 2, a grounding piece 3 and two signal lines 4 and 5. The main body 2 includes a grounding layer 20 and a wireless module 22. In an example where the portable electronic device is a laptop computer, the main body 2 includes a screen module, a motherboard, a keyboard and a casing. In fact, components incorporated in the main body 2 may vary with the types of the electronic devices. For instance, a tablet computer has a touch screen and is provided without a keyboard. In short, the composition of the main body 2 is not where the feature of the present invention relies on, and needs not to be described in detail.

The multi-frequency antenna 1 is deposited on the main body 2, and may be placed anywhere on the main body 2 according to the configuration of the main body 2. Therein, the first connecting arm 160 of the low-frequency radiation antenna 16 has a bottom provided with a feeding point 161. The grounding piece 3 has one end connected to the grounding arm 189 of the high-frequency radiation antenna 18 and an opposite end connected to the grounding layer 20 of the main body 2, so as to maximize the grounded areas of the multi-frequency antenna 1 and the main body 2. A signal line 4 has its two ends connected to the grounding arm 189 of the high-frequency radiation antenna 18 and the wireless module 22, respectively, while another signal line 5 has its two ends connected to the feeding point 161 of the first connecting arm 160 of the low-frequency radiation antenna 16 and the wireless module 22, respectively. Thereby, the wireless module 22 is enabled to transmit and receive packet data through the multi-frequency antenna 1. In fact, the disclosed multi-frequency antenna 1 may be applied to a desktop computer or a television set.

Figure 3:
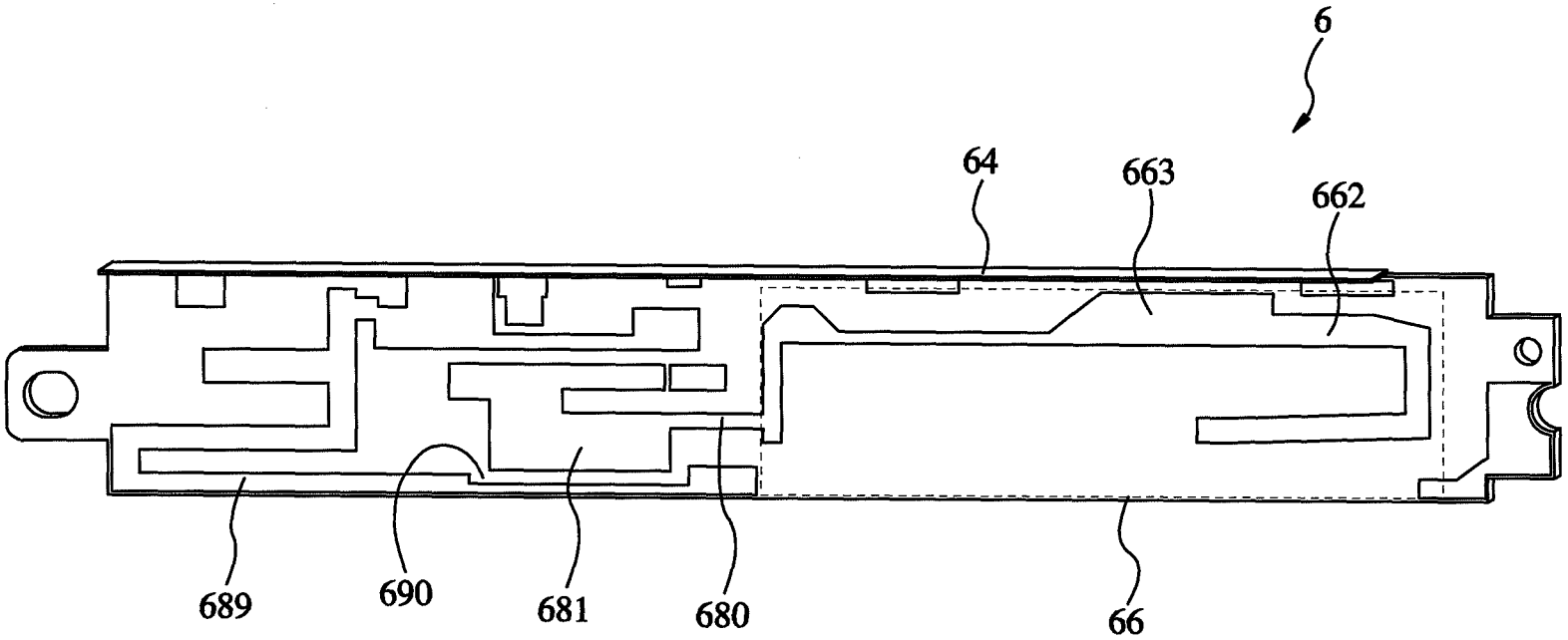
FIG. 3 is a schematic view of a multi-frequency antenna according to a second preferred embodiment of the present invention.
Figure 4:
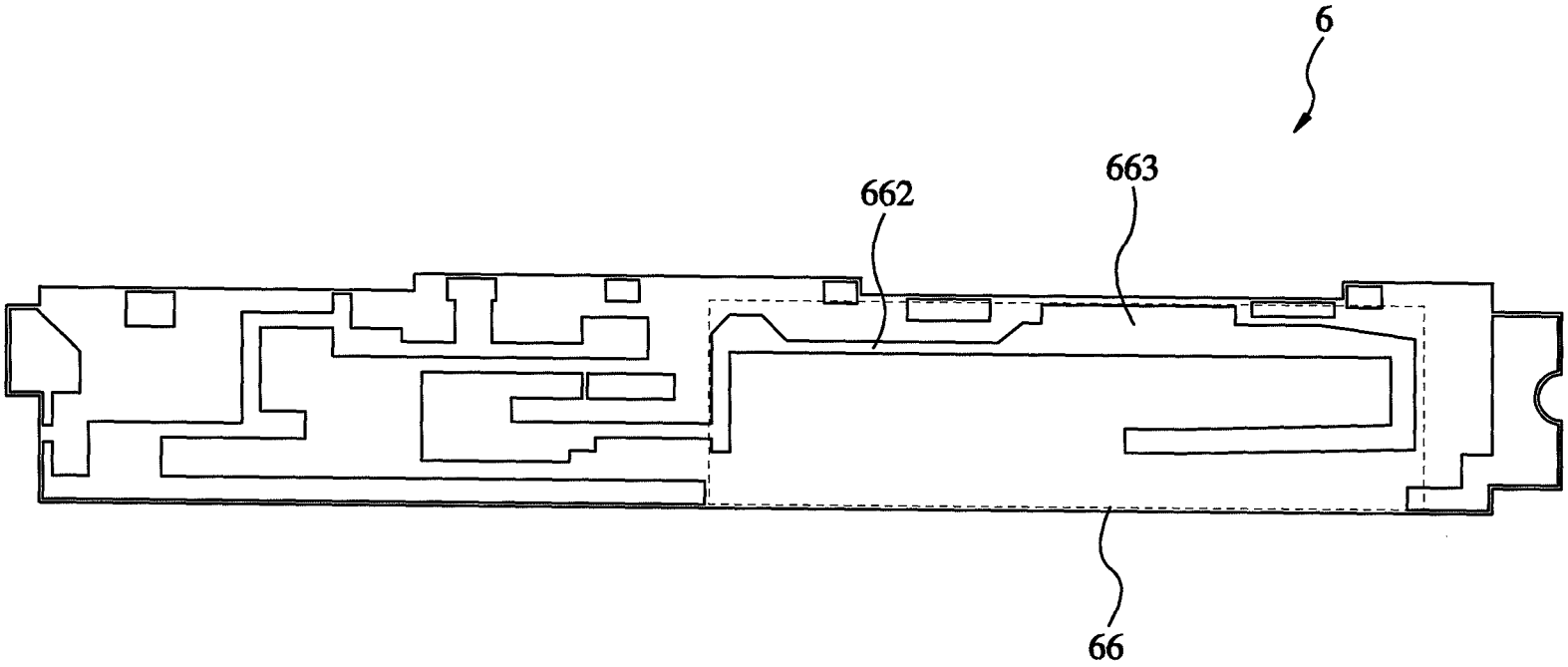
FIG. 4 is a schematic view of a multi-frequency antenna according to a third preferred embodiment of the present invention.
Figure 5:
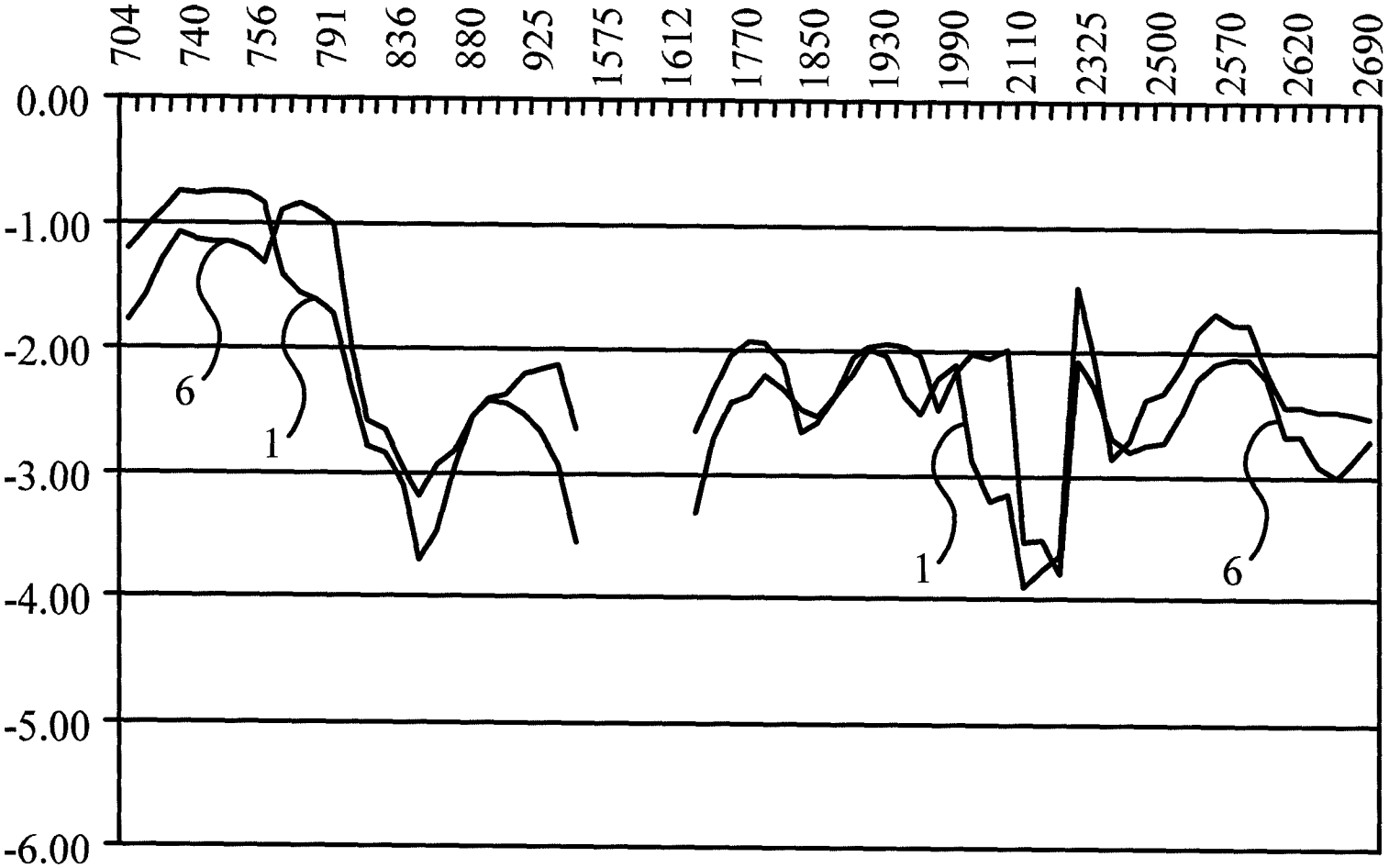
FIG. 5 is an efficiency graph of the multi-frequency antennas according to the first and second preferred embodiments.

However, the coupling between the low-frequency radiation antenna 16 and the radiator 14 can affect antenna efficiency in the frequency band of 2000~2700 MHz and of the entire low-frequency. Please refer to FIG. 3 and FIG. 4 for a second and third preferred embodiments of the present invention, wherein the solder joint of FIG. 1 is not shown in the multi-frequency antenna of FIG. 3 and the radiator is not shown in the multi-frequency antenna of FIG. 4. The multi-frequency antenna 6 also meets the technical requirements for LIE antennas. What makes the multi-frequency antenna 6 different from the first preferred embodiment is that the low-frequency radiation antenna 66 further comprises an extended portion 663 that is extended from the long arm 662 of the low-frequency radiation antenna 66 and located between the long arm 662 and the radiator 64. This means that the coupling gap between the low-frequency radiation antenna 66 and the radiator 64 is narrowed, making the radiation efficiency of the multi-frequency antenna 6 different from that of the multi-frequency antenna 1. FIG. 5 is an efficiency graph of the multi-frequency antennas of FIG. 1 and FIG. 3. The multi-frequency antennas 1 and 6 show different efficiency in different frequency bands. Therefore, by properly sizing the extended portion 663 at the design stage, the disclosed antenna can be made to meet the requirements for communication quality and antenna efficiency in different countries.

Referring back to FIG. 3, the matching arm 680 has a flange 681 and the grounding arm 689 has a recess 690. The flange 681 is aligned with the recess 690. Generally, the signal line has an impedance of 50 ohm (a), and the ideal impedance of the multi-frequency antenna is 50Ω for the perfect impedance matching between the multi-frequency antenna 6 and the signal line. In this case, signals transmitted to the multi-frequency antenna 6 through the signal line would not have reflection. However, in practice, the perfect impedance matching is difficult because it is only achievable when many uncontrollable factors (such as materials of components) are presented properly by chance. The present invention thus uses the foregoing configuration to make the impedance of the multi-frequency antenna 6 closer to 50 Ω.

Figure 6:
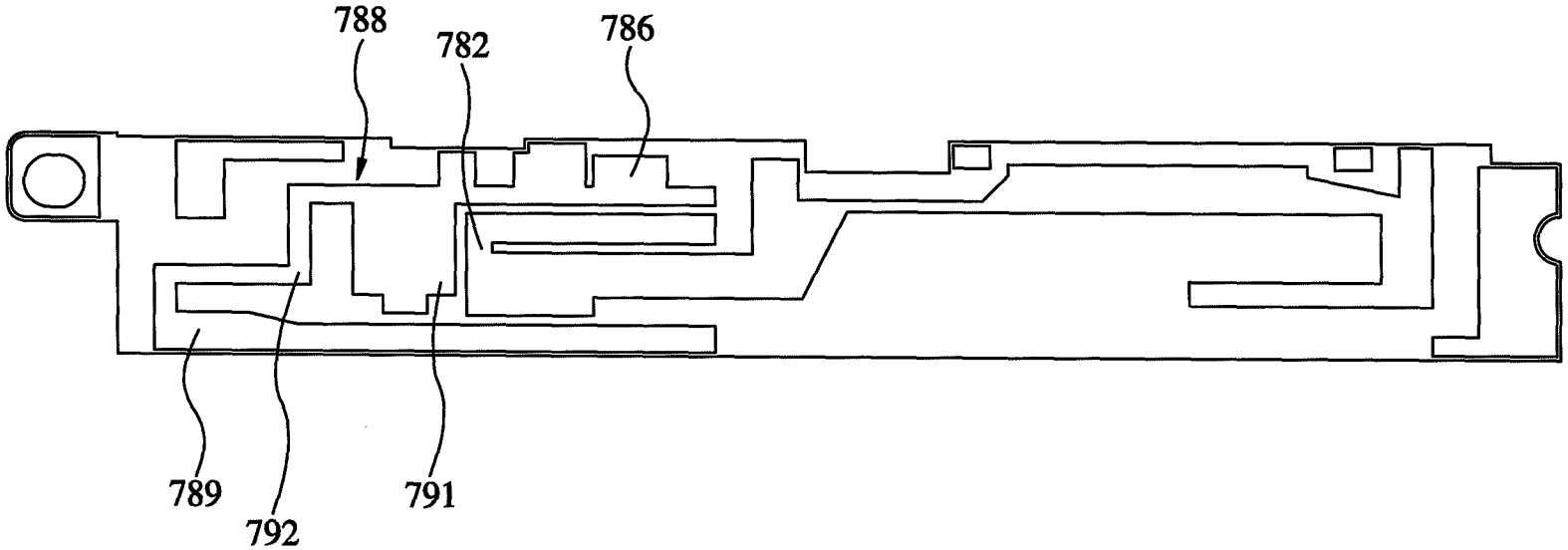
FIG. 6 is a schematic view of a multi-frequency antenna according to a fourth preferred embodiment of the present invention.

FIG. 6 is a schematic view of a multi-frequency antenna according to a fourth preferred embodiment of the present invention. The radiator is also omitted in the multi-frequency antenna of FIG. 6. As compared to the multi-frequency antenna 6 of the second preferred embodiment, in the multi-frequency antenna 7, the short-circuit member 788 has a lug 791 and a short-circuit arm 792. The lug 791 is formed at a front end of the second coupler 786 and is separated from the third connecting arm 782 by a gap. The short-circuit arm 792 is connected to the lug 791 and the grounding arm 789, while being separated from the lug 791 by a gap. The present embodiment is also designed to make the impedance of the multi-frequency antenna 7 as close to 50Ω as possible.

Figure 7:
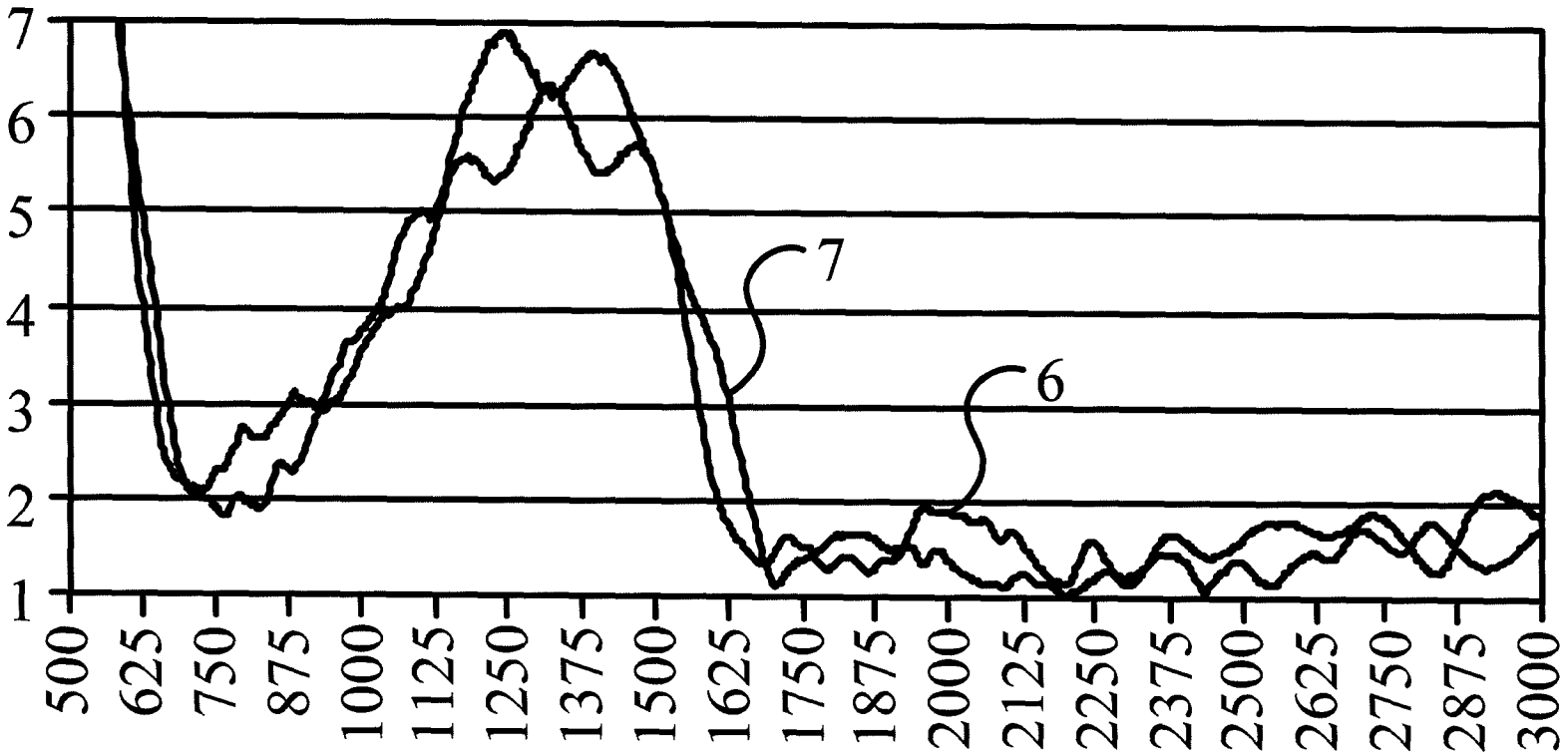
FIG. 7 is a comparative VSWR graph of the multi-frequency antennas according to the second and fourth preferred embodiments.

FIG. 7 is a comparative VSWR graph of the multi-frequency antennas according to the second and fourth preferred embodiments. The graphed VSWRs (Voltage Standing Wave Ratios) show the impedance matching of the multi-frequency antennas 6 and 7. As shown in FIG. 7, the VSWRs of the both embodiments in the frequency ranges of 704~960 MHz and 1710~2700 MHz are well controlled. Particularly, in the high frequency band, the VSWRs are close to 1, meaning that the impedance between the multi-frequency antennas and the input is almost perfect (i.e. 50 ohm).

What is claimed is:

1. A multi-frequency antenna, comprising:

a substrate;

an antenna portion being deposited on the substrate and located in one side of the substrate, the antenna portion comprising a low-frequency radiation antenna and a high-frequency radiation antenna, the low-frequency radiation antenna including a first connecting arm, a long arm, a second connecting arm and a short arm, the long arm having a front end connected to a top of the first connecting arm and a rear end connected to an upper end of the second connecting arm, the second connecting arm having a lower end connected to the short arm, the second connecting arm being aligned with the first connecting arm, the short arm being aligned with the long arm, the high-frequency radiation antenna including a matching arm, a third connecting arm, a first coupler, a second coupler, a short-circuit member and a grounding arm, the matching arm having a rear end connected to a bottom of the first connecting arm, the third connecting arm having a lower end connected to a front end of the matching arm, the first coupler being connected to an upper end of the third connecting arm and aligned with the matching arm, the second coupler being deposited between a top of the substrate and the first coupler, the short-circuit member having an upper end connected to the second coupler, the short-circuit member having a lower end connected to the grounding arm, and the grounding arm being deposited between a bottom of the substrate and the matching arm; and a radiator being deposited on the top of the substrate and facing the long arm of low-frequency radiation antenna and the second coupler of the high-frequency radiation antenna in the antenna portion, and the radiator being connected to the second coupler of the high-frequency radiation antenna.

2. The multi-frequency antenna of claim 1, wherein the low-frequency radiation antenna further includes an extended portion that is extended from the long arm and located between the long arm and the radiator.

3. The multi-frequency antenna of claim 2, wherein the matching arm has a flange and the grounding arm has a recess that aligned with the flange.

4. The multi-frequency antenna of claim 2, wherein the short-circuit member has a lug and a short-circuit arm, in which the lug is formed at a front end of the second coupler and separated from the third connecting arm by gap, and the short-circuit arm is connected to the lug and the grounding arm while being separated from the lug by a gap.

5. The multi-frequency antenna of claim 1, further comprising a grounding piece and two signal lines, wherein the grounding piece is connected to the grounding arm of the high-frequency radiation antenna, and one of the two signal lines is connected to the grounding arm while the other signal line is connected to a feeding point provided on a bottom of the first connecting arm.

* * * * *